United States Patent [19]

Boudin et al.

[11] Patent Number: 4,659,322

[45] Date of Patent: Apr. 21, 1987

[54] APPARATUS AND METHOD FOR PRODUCING A RESEALABLE CONTAINER

[76] Inventors: Leon L. Boudin, 74 Cliffside Dr., Daly City, Calif. 94015; Harry F. Duff, 2448 Mistletoe Dr., Hayward, Calif. 94545

[21] Appl. No.: 768,624

[22] Filed: Aug. 23, 1985

[51] Int. Cl.[4] ..... B31B 47/00; B31B 1/14

[52] U.S. Cl. ..... 493/57; 493/268; 493/340; 493/468; 493/901; 229/103; 229/45 R; 229/147; 229/154

[58] Field of Search ..... 493/51, 52, 56, 57, 493/268, 468, 478, 901, 909, 911, 340, 342; 229/45 R, 103

[56] References Cited

U.S. PATENT DOCUMENTS

| | | | |
|---|---|---|---|
| 1,054,521 | 2/1913 | Ellis | 493/51 |
| 1,147,276 | 7/1915 | Southard . | |
| 1,519,813 | 12/1924 | Scott | 229/147 |
| 2,527,705 | 10/1950 | Crary et al. | 229/45 R |
| 2,638,820 | 5/1953 | Barnes | 493/56 |
| 2,826,969 | 3/1958 | Wasyluka et al. | 493/468 |
| 3,015,197 | 1/1962 | Eichorn . | |
| 3,190,532 | 6/1965 | Marsh | 229/103 |
| 3,680,766 | 8/1972 | Collura et al. | 229/45 R |
| 3,901,432 | 8/1975 | Lancaster | 229/45 R |
| 3,913,827 | 10/1975 | Brulkner et al. | 229/45 R |
| 4,330,289 | 5/1982 | Christensson . | |

*Primary Examiner*—Lowell A. Larson
*Assistant Examiner*—William E. Terrell
*Attorney, Agent, or Firm*—Fitch, Even, Tabin & Flannery

[57] ABSTRACT

A unique resealable container is described together with a method for converting a standard container of the type commonly used for packaging milk or other liquids into said container. An apparatus for carrying out this method is also described. The resealable container consists of a rectangular box having four flaps and a closing band for sealing the box. The closing band holds the flaps in their closed position. The container may be produced by making six cuts in a standard container of the type normally used to package milk or the like. The cuts are made with the apparatus of the present invention using an ordinary kitchen knife. The apparatus of the present invention supports the container during the cutting process and guides the knife to assure that the cuts are made in the correct locations.

7 Claims, 14 Drawing Figures

APPARATUS AND METHOD FOR PRODUCING A RESEALABLE CONTAINER

BACKGROUND OF THE INVENTION

The present invention relates to resealable containers such as those used for the storage of food stuffs.

Containers for the storage of food in household refrigerators or freezers are well known to the prior art. Ideally such containers are inexpensive, easy to fill and to seal, and of a shape which makes efficient use of the space in the refrigerator or freezer in question. The least expensive containers are plastic bags which may be sealed by any of a number of methods. Although these containers are inexpensive, they are difficult to fill without an additional supporting apparatus. In addition, due to their non-rigid shape they are difficult to stack in the refrigerator or freezer; hence they are inefficient in their space utilization.

Numerous reusable rigid wall plastic containers are also known to the prior art. These containers are expensive, but reusable. They are easy to fill and seal and stack well in the refrigerator or freezer. However, they tend to loose their shape after several washings in modern dishwashers. As a result, they begin seal poorly and must be discarded. Ideally, one would like to have an inexpensive disposable or semi-disposable container which is rigid and rectangular in shape for efficient use of storage space. Unfortunately, the cost of shipping such rigid containers places a lower limit on their cost.

Many foodstuffs come in containers which must be discarded after use. Ideally, these containers could be used at least once for food storage after they are emptied of their original contents. For example, milk and other liquids are sold in leakproof paper containers of a standard size. Unfortunately, when emptied, these containers are of little use. The opening provided for dispensing milk or other material from these containers is usually too small to allow easy refilling, and more importantly no way is provided for reestablishing a substantially airtight seal. Various forms of sealing materials can be used to seal these containers such as aluminum foil; however, containers covered with a flexible sealing material are difficult to stack on top of each other and obtaining and maintaining a good seal is not easy.

Consequently, it is an object of the present invention to provide an inexpensive, easily resealable container which can also be easily stacked on top of one another in a refrigerator or like space.

It is a further object of the present invention to provide a means for recycling containers of the type used for packaging milk or other liquids.

These and other objects of the present invention will become evident from the following detailed description of the invention and accompanying drawings.

SUMMARY OF THE INVENTION

The present invention consists of a unique resealable container, a method for converting a standard container of the type commonly used for packaging milk or other liquids into the resealable container of the present invention, and an apparatus for carrying out this method. By starting with a container which is already present in the consumer's home, the present invention avoids the costs of shipping which would otherwise determine the minimum cost of such a rigid wall food storage container. The resealable container consists of a rectangular box having four flaps and a closing band for sealing the box. The closing band holds the flaps in their closed position. The container may be produced by making six cuts in a standard container of the type normally used to package milk or the like. The cuts are made with the apparatus of the present invention using an ordinary kitchen knife. The apparatus of the present invention supports the container during the cutting process and guides the knife to assure that the cuts are made in the correct locations.

BRIEF DESCRIPTION OF THE DRAWINGS

FIG. 3(*b*) is a side view of the container shown in FIG. 3(*a*).

FIG. 7(*b*) is a cross-sectional view of the starting container illustrating the use of the apparatus of FIG. 5 to remove the top of the starting container.

FIG. 7(*c*) is a cross-sectional view of the starting container illustrating the use of the apparatus of the present invention to make the cut for forming the closing band of the resealable container.

FIG. 7(*d*) is a cross-sectional view of the starting container illustrating the use of the apparatus of the present invention for making the last four cuts needed to convert the starting container into a resealable container according to the present invention.

FIG. 7(*e*) is a top plan view of the starting container and apparatus as shown in FIG. 7(*d*).

DETAILED DESCRIPTION OF THE INVENTION

Figure 1:
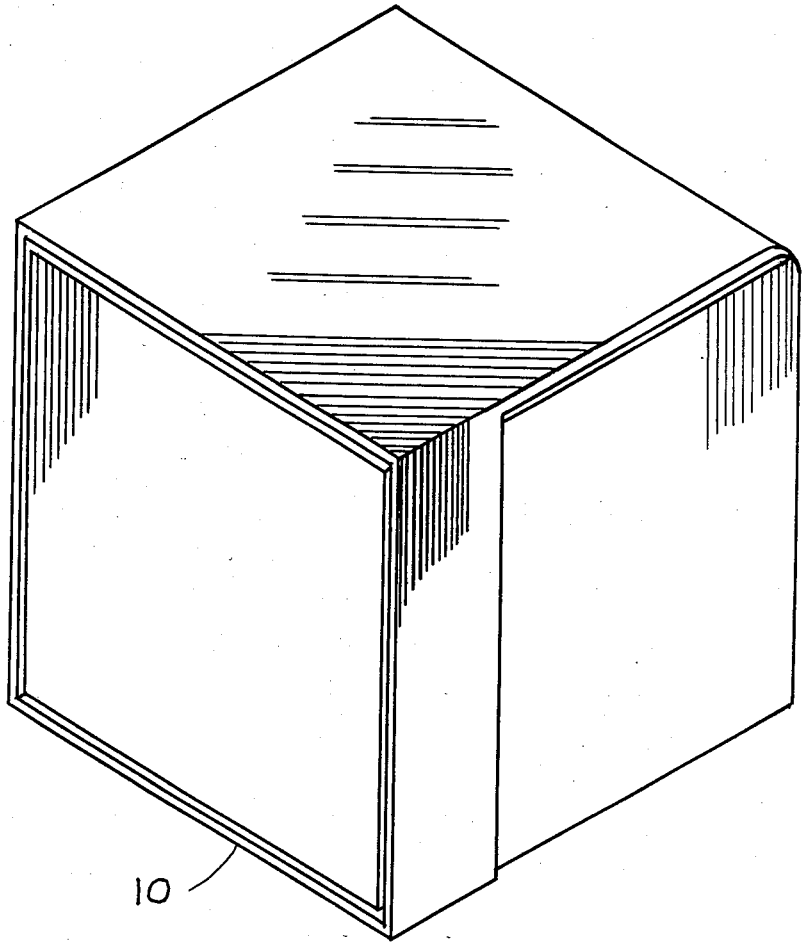
FIG. 1 is a perspective view of a resealable container according to the present invention in a closed configuration.
Figure 2:
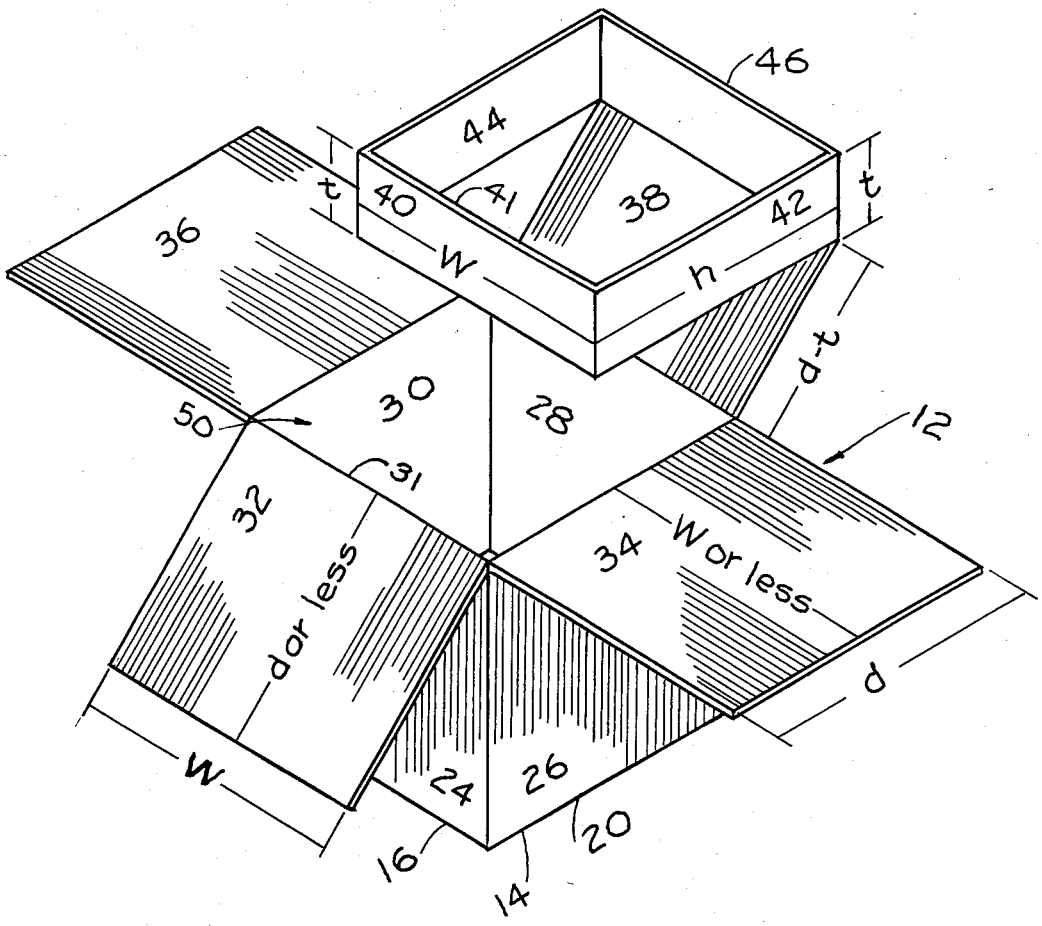
FIG. 2 is a perspective view of a resealable container according to the present invention in an open configuration.

The resealable container of the present invention is shown in FIG. 1 at 10 in its sealed configuration and at 12 FIG. 2 in its open configuration. Referring to FIG. 2, the resealable container 10 has a rectangular bottom 14 having front and back edges, which are of length w and left and right edges, which are of length d. The front edge is shown at 16. The right edge is shown at 20. The container 10 has four vertical sides, a front side 24, a right side 26, a back side 28 and a left side 30. Each vertical side is joined to said bottom and to the vertical sides adjacent to said vertical side.

Each vertical side is also joined to a flap which is hingedly connected to said vertical side along the top edge of said vertical side. The front flap 32 is joined to the upper edge 31 of the front side. It has a width of w and a length of d or less. Similarly, the left flap 36 and right flap 34 are joined respectively to the left side 30 and the right side 26 at the upper edge of the side in question. The left flap 36 and right flap 34 each have widths of d and lengths of w or less. The back flap 38 is joined to the back side 28 at the upper edge of said back flap. Back flap 38 has a width of w and a length of d.

A closing band 40 is attached to the upper end of the back flap 38 such that the upper edge of the closing band 41 and the upper edge of the back flap 46 lie in the same plane. The circumference of the closing band 40 is equal to twice the height h of the container plus twice the width w of the container. In the preferred embodiment, the closing band 40 is a rectangular band having a height t, a right side 42 and a left side 44 each of length h and a front side of length w and a back side of width w. In the preferred embodiment, the closing band 40 is formed as an integral part of the back flap 38. Embodiments in which the closing band 40 is formed separately and then attached to said back flap will be apparent to those skilled in the art.

The resealable container is sealed by bending the left and right flaps 34, 36 inward so as to cover the opening 50 in the top of the container. The front flap 32 is then likewise bent inward. Finally the back flap 38 is bend toward the front side 24. The closing band 40 encircles right side 26, the bottom 14 and the left side 30 thus securing the back flap 38 on top of flaps 32, 34 and 36. The closing band 40 must be made of a material which is sufficiently flexible to allow the closing band to slide over the front edge 16. Similarly, the height, t, of the closing band must be sufficiently small to allow the closing band to slide over the front edge 16, while also being sufficiently large to provide structural strength to the closing band. In the preferred embodiment, the entire resealable container 10 is made from leakproof paper, and the height of the closing band is chosen to be approximately 25% of the length d of the container 10.

Figure 3:
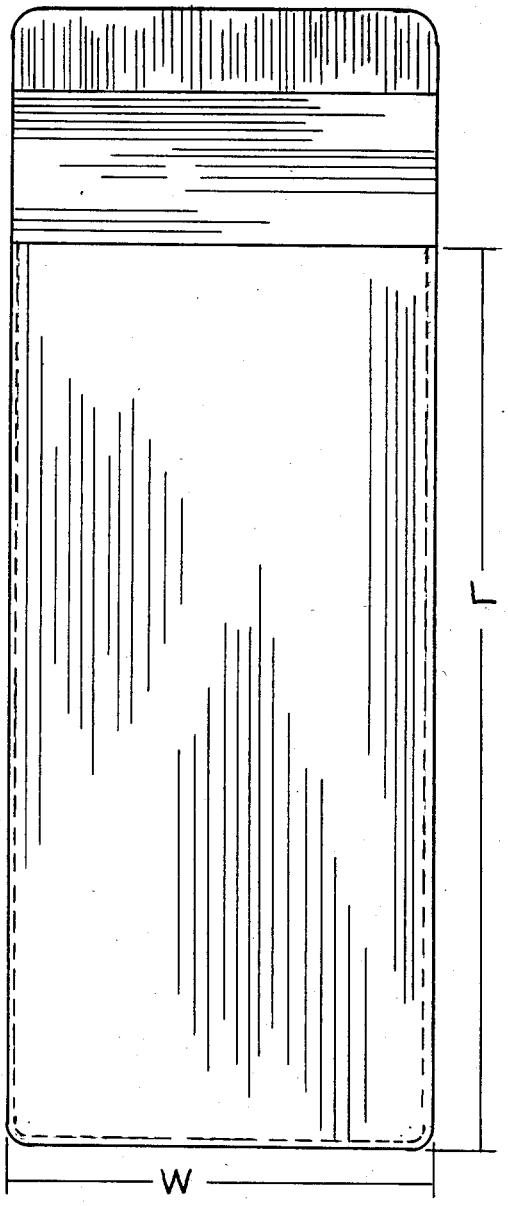
FIG. 3(*a*) is a first view of a container which can be used as a starting container for constructing the container of the present invention.
Figure 3:
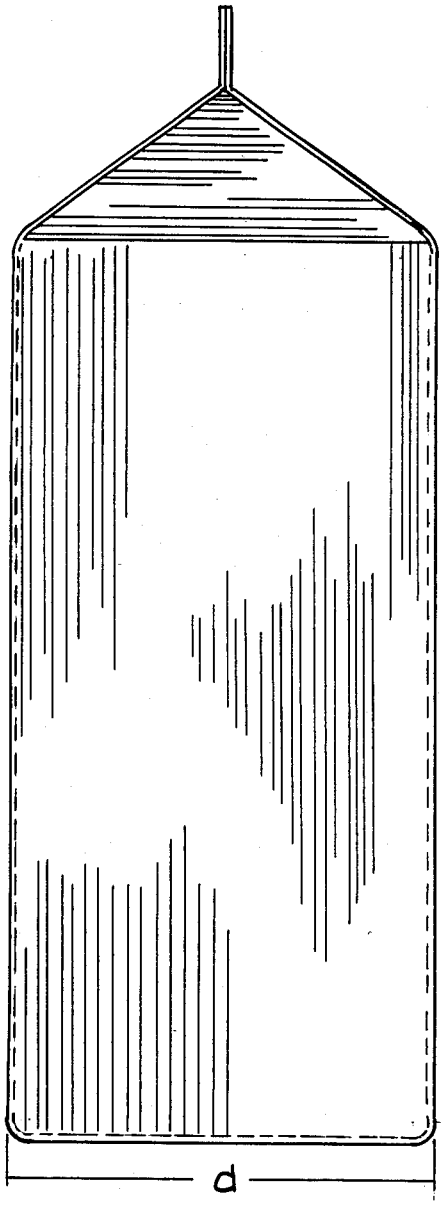

The resealable container 10 of the present invention may be constructed from any starting container made of an appropriate material which has a rectangular base having a width, w, and a depth, d, and vertical rectangular sides having a length, L, greater than h plus d, where h is the height of the resealable container as described above. Where the resealable container is constructed from a starting container as hereinafter described, the height of the resealable container, h, must equal the depth, d, of the starting container to enable closing band 40 to function properly. In the preferred embodiment, a leakproof paper starting container of the type commonly used to package milk or other liquids is used. Such a container is shown in FIG. 3.

Figure 4:
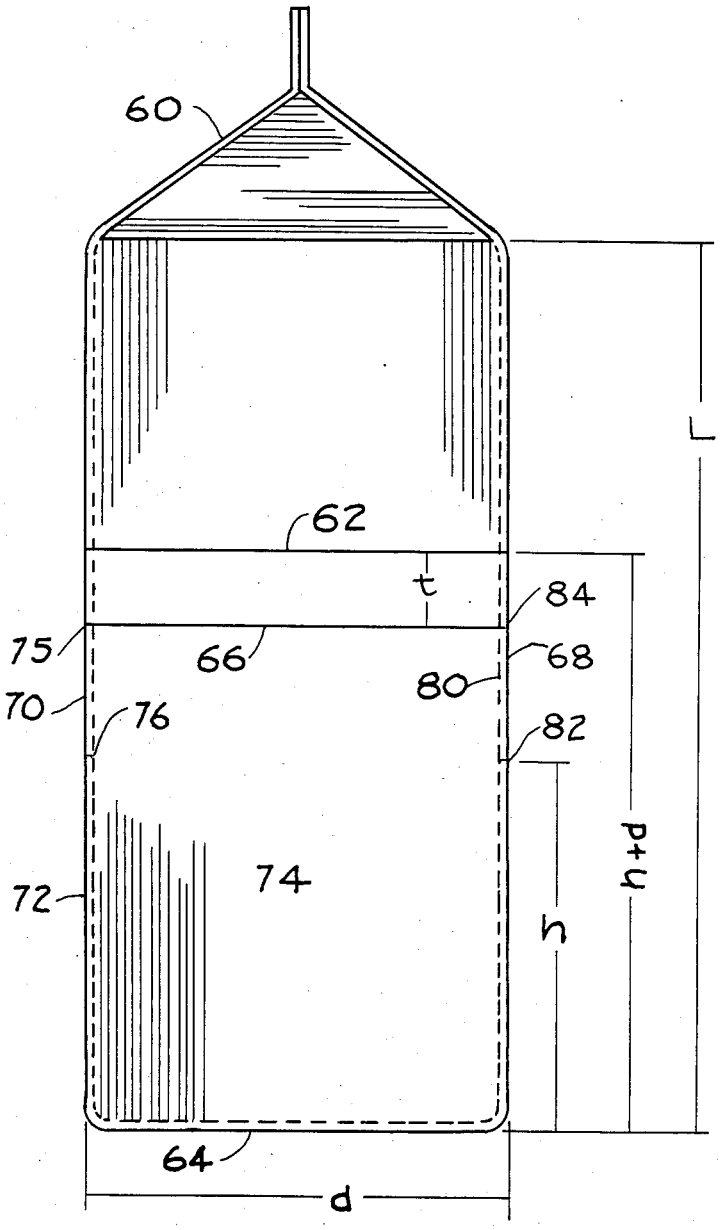
FIG. 4 illustrates the conversion of a standard container of the type used to package milk into a resealable container according to the method of the present invention.

Referring to FIG. 4, the starting container 60 is converted into the resealable container 10 of the present invention by making six (6) cuts in the starting container. Referring to FIG. 4, the first cut removes the top of the starting container 60 leaving an open topped container of height h plus d, or $2\times d$. This cut is made in a plane 62 parallel to the bottom 64 of the starting container at a height of h plus d above said bottom.

The second cut is made in a plane 66 parallel to the bottom 64 of the starting container. This plane is at a height of h plus d minus t above said bottom, where t is the thickness of the closing band 40 as defined above. Only the front side, left side, and right side of the starting container 60 are cut in this second cut. The back side 68 of the starting container 60 is not cut. This second cut forms the closing band 40 and defines the top edges of flanges 32, 34 and 36.

The next four cuts complete the formation of flaps 32, 34, and 36 and also back flap 38. The third cut is made along the line 70 formed by the intersection of the of the front side 72 and the right side 74 of the starting container. The cut is made from the point 75 at which this line intersects the plane 66 and a point 76 which is at a distance h above the bottom 64 of said starting container.

Similarly, the fourth cut is made along the line formed by the intersection of the front side 72 of the starting container and the left side of the starting container which is not visible in FIG. 4. The cut is made from the point at which this line intersects the plane 66 and the point on said line which is at a distance h above the bottom 64 of said starting container.

Likewise, the fifth cut is made along the line formed by the intersection of the back side 68 of the starting container and the left side of the starting container which is not visible in FIG. 3. The cut is made from the point at which this line intersects the plane 66 and the point on said line which is at a distance h above the bottom 64 of said starting container.

Finally, the sixth cut is made along the line 80 formed by the intersection of the back side 68 and the right side 74 of the starting container. The cut is made from the point 84 at which this line intersects the plane 66 and a point 82 which is at a distance h above the bottom 64 of said starting container.

Figure 5:
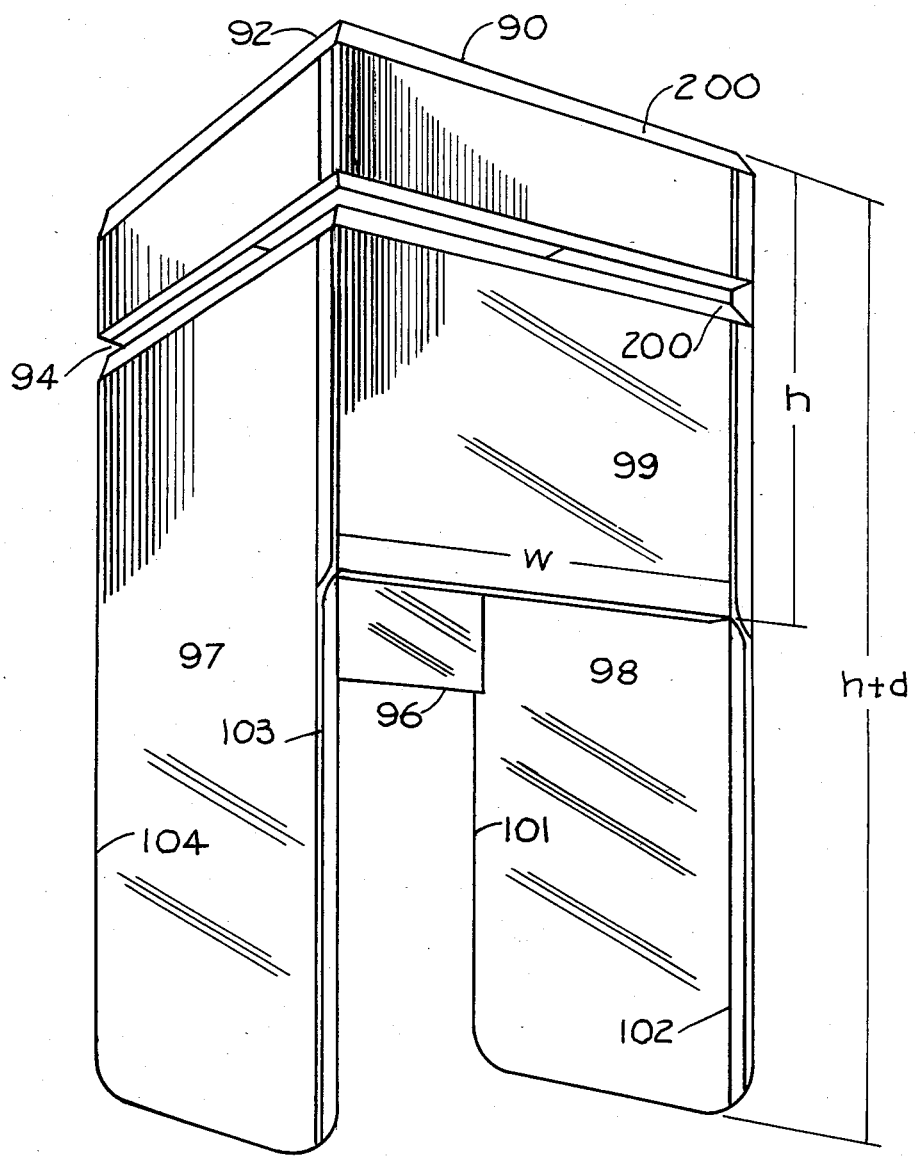
FIG. 5 is a perspective view of the apparatus of the present invention which is used in making the conversion shown in FIG. 4.
Figure 6A:
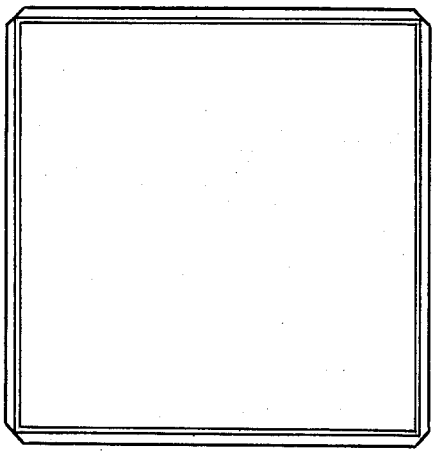
FIGS. 6(*a*), (*b*), and (*c*) are top, side and front views, respectively, of the apparatus of the present invention.
Figure 6B:
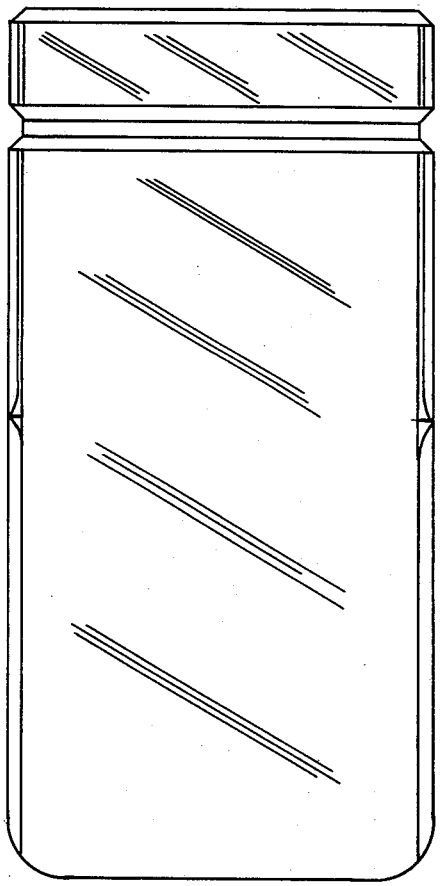
Figure 6C:
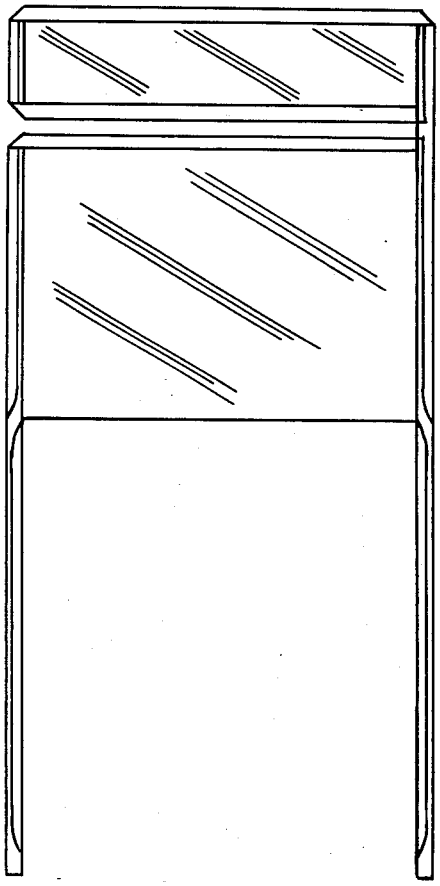

The apparatus of the preferred embodiment of the present invention for facilitating the making of the above cuts using a cutting tool, such as a kitchen knife, is shown in FIG. 5. The apparatus consists of a rigid module 90 which is inserted into the starting container. Module 90 may be constructed out of rigid plastic formed using conventional molding techniques or constructed in other ways well known in the art. Transparent plastic may be used in constructing module 90. As seen in FIG. 5, module 90 has four sides 96, 97, 98, and 99. A slot 94 is formed through sides 96, 97, and 99. Sides 97 and 98, which are referred to as the long sides, are of a height equal to h plus d. Sides 96 and 99 which are referred to as the short sides, are of a height h. The module 90 is shown in in top, side, and front views in FIGS. 6(*a*), 6(*b*), and 6(*c*), respectively.

The module 90 supports the starting container during the cutting operations and provides six surfaces for guiding the cutting tool during the six cutting operations described above. The first cut is made by guiding the cutting tool along the surface 92. The second cut is made by guiding the cutting tool through the slot 94. Cuts three through six are made by guiding the cutting tool along the edges 101, 102, 103, and 104 of the module 90, once the position of module 90 has been reversed in the starting container, as described below.

Figure 7A:
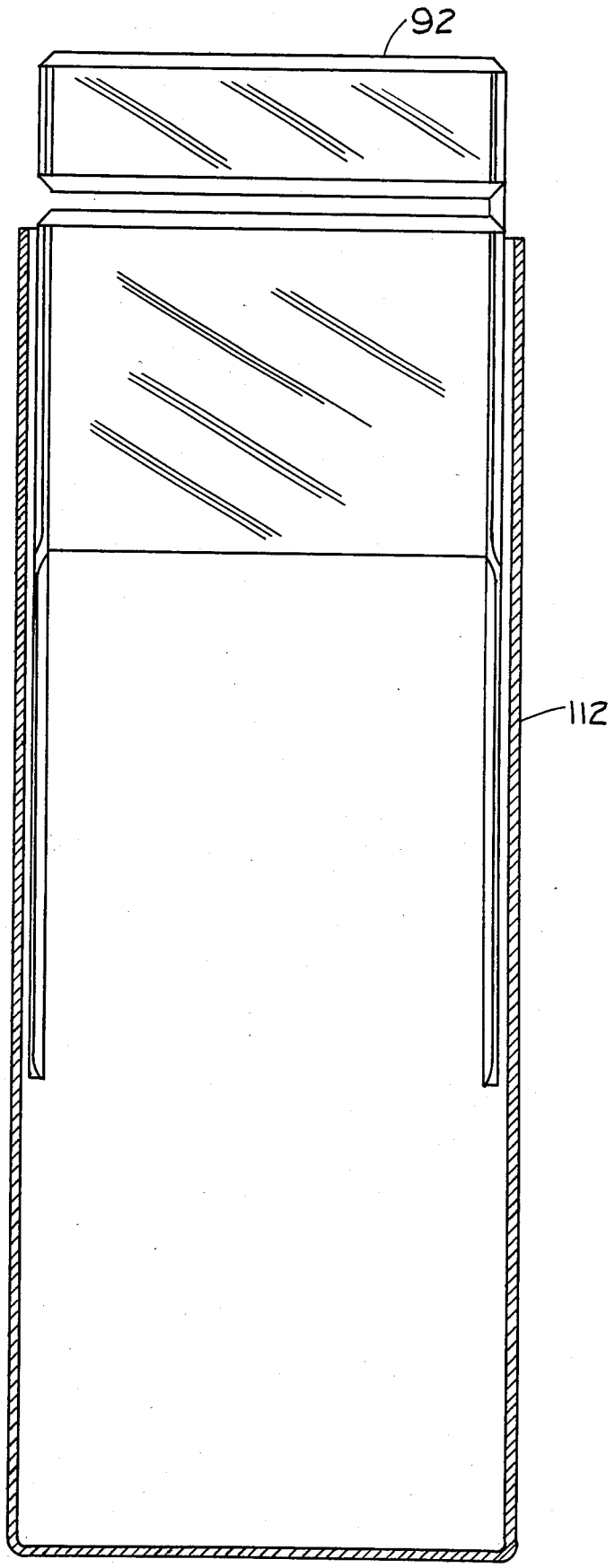
FIG. 7(*a*) is a cross-sectional view of the starting container shown in FIG. 3 illustrating the insertion of the apparatus of FIG. 5 into said container.
Figure 7B:
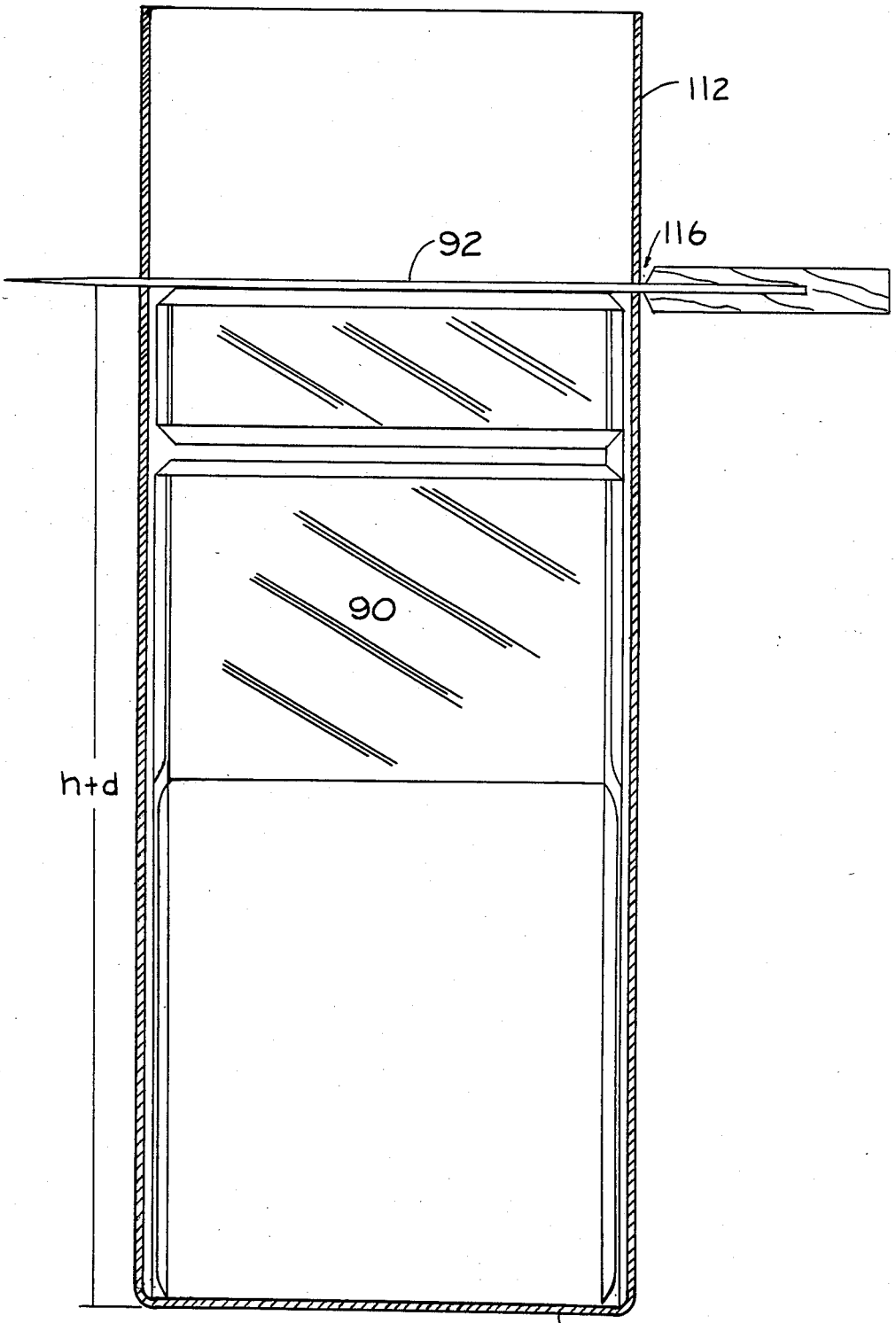
Figure 7:
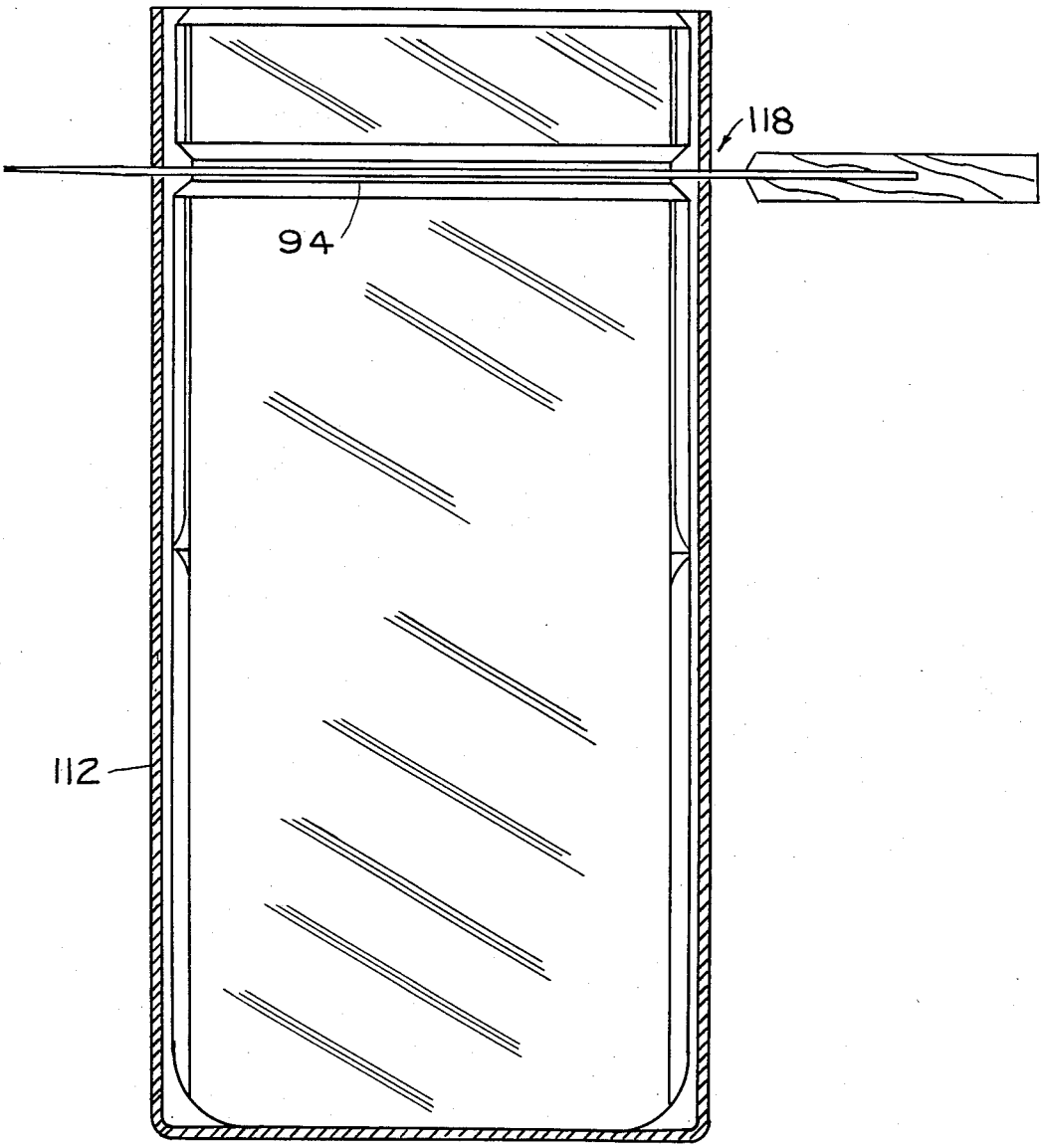
Figures 7, 7E:
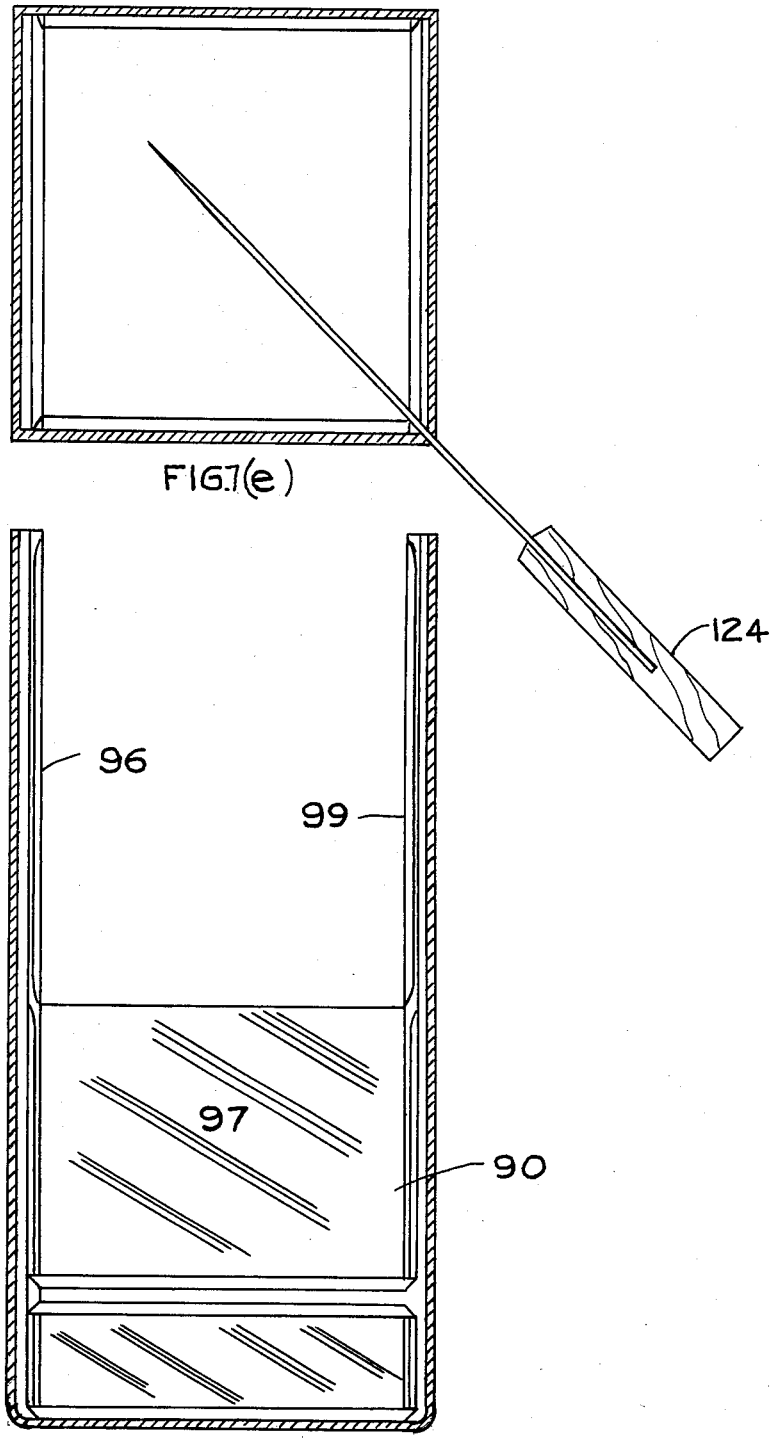

More specifically with reference to FIG. 7(*a*), the module 90 is first inserted into a starting container whose top has been fully opened, shown at 112, with the surface 92 of module 90 being nearest the top of the starting container 112. Preferrably, module 90 is sized to create a snug fit when it is inserted into the starting container 112. The top of the starting container is then removed by cutting the starting container 112 using a cutting tool guided by the surface 92 as shown at 116 as shown in FIG. 7(*b*). The closing band is then formed as an integrated part of the back flap 38 by cutting the starting container 112 with the cutting tool guided by slot 94 as shown at 118 in FIG. 7(*c*). The back side 98 of the module shown, in FIG. 5, prevents the cutting tool from completely cutting through the starting container during this second cut.

The module 90 is then removed from the starting container, inverted, and re-inserted in the starting container 112 as shown in FIG. 7(*d*). The closing band is bent out of the way so as not to interfere with the remaining 4 cuts. The closing band is not shown in FIG. 7. The two long sides of the module 96 and 99 support the starting container and provide surfaces for guiding the cutting tool during cuts three through 6. Each cut is made by guiding the cutting tool 124 along the appropriate long side of the module 90 as shown in FIG. 7(*e*) until it is stopped by the edge of the short side of the module. For example, the third cut described above is made by guiding the cutting tool along the edge of the module side 99 until it reaches the edge of the short side 97 at point 130. After cuts three through six are completed, the module is removed from the starting container, and the resealable container of the present invention is then useable.

To assist in cutting, chamfers or beveled edges may be formed in module 90 as at 200 in FIG. 5. A chamfer surface of 45° is typical. Such beveled edges enable the cutting knife to be easily guided into the slot initially and thereafter guided down the cutting edge during cutting.

Various modifications of the present invention will be apparent to those skilled in the art without departing from the present invention as claimed.

What is claimed is:

1. A method for converting a starting container having a bottom which is rectangular in shape, having a front and back edges of length w and left and right edges of length d, a front side which is rectangular in shape, having top and bottom horizontal edges of length w and left and right vertical edges of length 1, said bottom edge of said front side being joined to said front edge of said bottom, a left side which is rectangular in shape, having top and bottom horizontal edges of length d and left and right vertical edges of length 1, said bottom horizontal edge of said left side being joined to said left edge of said bottom, and said right vertical edge of said left side being joined to said left vertical edge of said front side, a right side which is rectangular in shape, having top and bottom horizontal edges of length d and left and right vertical edges of length 1, said bottom horizontal edge of said left side being joined to said right edge of said bottom, and said left vertical edge of said right side being joined to said right vertical edge of said front side, and a back side which is rectangular in shape, having top and bottom horizontal edges of length w and left and right vertical edges of length 1, said bottom horizontal edge being joined to said back edge of said bottom, said left vertical edge being joined to said right vertical edge of said right side, and said right vertical edge being joined to said left vertical edge of said left side, into a resealable container of height h, wherein said length 1 is greater than the sum of the height h of said resealable container plus d, comprising the steps of:

(a) cutting said front side, back side, left side, and right side of said starting container along the intersection of the plane which is parallel to said bottom of said starting container and which intersects said front side, back side, left side, and right side at a distance of h plus d from said bottom;

(b) cutting said front side, left side, and right side of said starting container along the intersection of the plane which is parallel to said bottom of said starting container and which intersects said front side, left side, and back side at a distance of h plus d minus t from said bottom;

(c) cutting said starting container along the intersection of said front side and said left side, said cut extending from the point on said intersection which is at a distance h from said bottom to the point on said intersection which is at a distance h plus d minus t from said bottom;

(d) cutting said starting container along the intersection of said front side and said right side, said cut extending from the point on said intersection which is at a distance h from said bottom to the point on said intersection which is at a distance h plus d minus t from said bottom;

(e) cutting said starting container along the intersection of said back side and said right side, said cut extending from the point on said intersection which is at a distance h from said bottom to the point on said intersection which is at a distance h plus d minus t from said bottom; and (f) cutting said starting container along the intersection of said back side and said left side, said cut extending from the point on said intersection which is at a distance h from said bottom to the point on said intersection which is at a distance h plus d minus t from said bottom.

2. An apparatus for use with a cutting tool for converting a starting container having a bottom which is rectangular in shape, having a front and back edges of length w and left and right edges of length d;

a front side which is rectangular in shape, having top and bottom horizontal edges of length w and left and right vertical edges of length 1, said bottom edge of said front side being joined to said front edge of said bottom;

a left side which is rectangular in shape, having top and bottom horizontal edges of length d and left and right vertical edges of length 1, said bottom horizontal edge of said left side being joined to said left edge of said bottom, and said right vertical edge of said left side being joined to said left vertical edge of said front side;

a right side which is rectangular in shape, having top and bottom horizontal edges of length d and left and right vertical edges of length 1, said bottom horizontal edge of said left side being joined to said right edge of said bottom, and said left vertical edge of said right side being joined to said right vertical edge of said front side;

a back side which is rectangular in shape, having top and bottom horizontal edges of length w and left and right vertical edges of length 1, said bottom horizontal edge being joined to said back edge of said bottom, said left vertical edge being joined to said right vertical edge of said right side, and said right vertical edge being joined to said left vertical edge of said left side;

into the resealable container of height h, wherein said length 1 is greater than the sum of the height h of said resealable container plus d, comprising:

first planar guiding means for guiding said cutting tool in a plane parallel to the bottom of said starting container at a distance h plus d from said bottom;

second planar guiding means for guiding said cutting tool in a plane parallel to the bottom of said starting container at a distance of h plus d minus t from said bottom;

first vertical guiding means for guiding said cutting tool along the intersection of said left side and said front side of said starting container including stop means for preventing said cutting tool from cutting said starting container at a point closer than h to said bottom;

second vertical guiding means for guiding said cutting tool along the intersection of said right side and said front side of said starting container including stop means for preventing said cutting tool from cutting said starting container at a point closer than h to said bottom;

third vertical guiding means for guiding said cutting tool along the intersection of said right side and said back side of said starting container including stop means for preventing said cutting tool from cutting said starting container at a point closer than h to said bottom; and fourth vertical guiding means for guiding said cutting tool along the intersection of said left side and said back side of said starting container including stop means for preventing said cutting tool from cutting said starting container at a point closer than h to said bottom.

3. The apparatus of claim 2 wherein said second planar guiding means further comprises stop means for preventing said cutting tool from cutting said back side of said starting container.

4. The apparatus of claim 2 wherein said apparatus inserts into said starting container, supporting the sides thereof.

5. The apparatus of claim 3 wherein each said guiding means comprises a surface for supporting and guiding said cutting tool.

6. The apparatus of claim 5 wherein at least one of said surfaces includes a beveled edge.

7. The apparatus of claim 5 wherein said first and second planar guiding means are positioned relative to said container by inserting said apparatus into said container in a first orientation and said first, second, third, and fourth vertical guiding means are positioned relative to said container by inserting said apparatus into said container in a second orientation.

* * * * *